United States Patent [19]

Boyer

[11] 4,050,268

[45] Sept. 27, 1977

[54] PROCESS FOR FORMING PANTY HOSE AND AN ARTICLE FORMED THEREBY

[75] Inventor: Jo Clara Boyer, Los Angeles, Calif.

[73] Assignee: Saviano, A.G., Balzers, Liechtenstein

[21] Appl. No.: 656,739

[22] Filed: Feb. 9, 1976

[30] Foreign Application Priority Data

Feb. 10, 1975 Germany ..... 2505536

[51] Int. Cl.[2] ..... D04B 9/00

[52] U.S. Cl. ..... 66/19; 66/177; 66/172 E; 66/41

[58] Field of Search ..... 66/177, 176, 175, 17, 66/172 E, 19

[56] References Cited

U.S. PATENT DOCUMENTS

| | | | |
|---|---|---|---|
| 3,938,355 | 2/1976 | Conti | 66/177 |
| Re. 27,886 | 1/1974 | Johnson | 66/177 |

FOREIGN PATENT DOCUMENTS

| | | | |
|---|---|---|---|
| 2,300,955 | 7/1974 | Germany | 66/177 |

*Primary Examiner*—Ronald Feldbaum

[57] ABSTRACT

Process for forming a panty-hose with a continuous rotational motion of the needle cylinder, in a circular hosiery machine.

After forming a first leg portion, the body porton is formed by going on knitting along a needle arc, by cyclically activating and disactivating, along two semiarcs, variable needle arcs by anchoring the produced partial courses to the continuous ones, thus forming two about disc shaped areas - front and rear - and an arcuated and tapered knit; after closure of said disc shaped areas, working is resumed to form the second leg portion.

5 Claims, 13 Drawing Figures

Fig.1
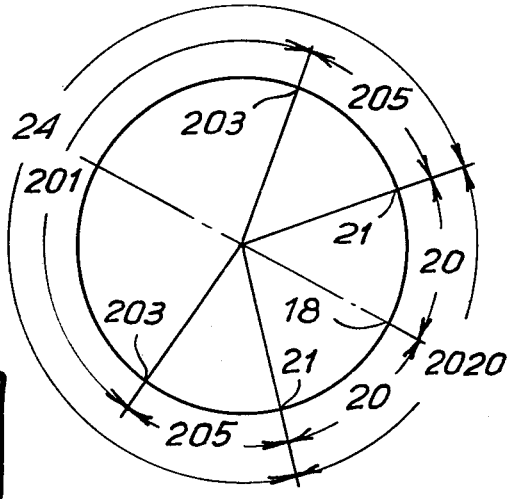
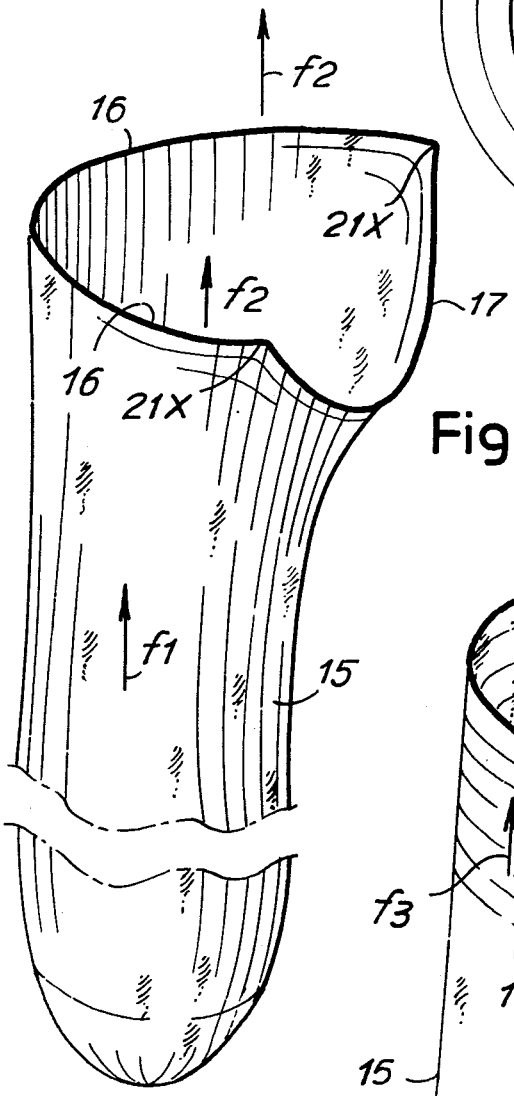
Fig. 2
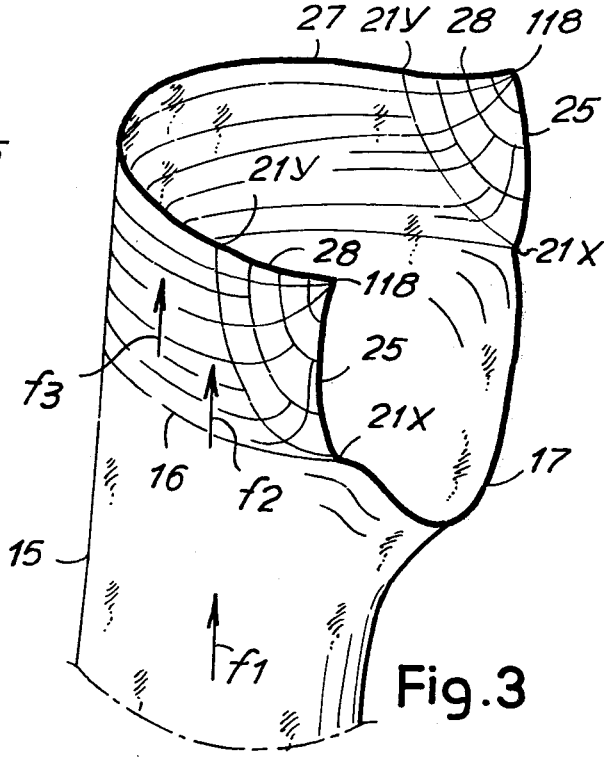
Fig.3

PROCESS FOR FORMING PANTY HOSE AND AN ARTICLE FORMED THEREBY

The invention has as its first object a process for the forming of an article of the panty-hose type with a continuous rotational motion of the needle cylinder in a circular knitting machine, which is provided with retaining means - such as sinkers with a rear recess, per se known - to support the knit fabric along the working area of the cylinder needles, so as to receive it from the needles and reatin it, and subsequently it to the needles. According to the invention, said process includes: forming a first leg-portion of tubular knit fabric by knitting with all the needles; engaging a portion of the working front of the knit fabric on said retaining means along a first arc of needles corresponding to the crotch portion, and retaining said knit fabric thereon, with the needles being free to knit fabric separate from the portion on said retaining means; starting two initial edges of two disc like areas along two semi-arcs in which said first arc is divided by a central origin and retaining said initial edges; forming the body portion by further knitting along the arc supplementary to said first arc and with pocket-shaped portions formed between said retained initial edges and the active needles of both said semi-arcs, variable arcs of needles starting from said origin being cyclically activated and deactivated, along both semi-arcs, and the partial made up courses being anchored to the contiguous ones, thus forming two — front and rear — disc areas and an arcuated tapered fabric; connecting said initial edges and the corresponding end edges along said two contiguous semiarcs, symmetrical to the origin and forming a final unthreading lip of the needles of said two semiarcs; resuming by said first arc needles the knitting along the line retained by said retaining means; starting a second tubular leg portion knit along said first crotch portion arc formed by said two contiguous semiarcs and by the origin included therebetween, said second tubular knit portion being partly formed as a continuation of the working front of the needles of the arc supplemental to said crotch portion first arc.

During the formation of the body portion an opening for the waist line may be made by discontinuing and then resuming the knitting process along a second needle arc opposite to said origin and symmetrical with respect to the diametrical direction defined by said origin; said opening is partly finished with final unthreading lips and may present a sheath-like double edge. The initial edges may be retained by means of the hooks of a dial, but said initial edges may be advantageously retained by needles kept inactive and intervening — for instance with a 1:3 ratio — with active knitting needles. A sheath-like double edge of said opening may be worked between the needles and the dial hooks along said second arc and advantageously by means of a elastic yarn.

The invention will also relate to an article made with the above process and having the resulting structural features.

The invention will be better understood following the specification and the accompanying drawing which illustrates an embodiment not restricting the same invention. In the drawing:

FIG. 1 is a schematic circular diagram showing the partition of the needle circumference into several arcs;

FIGS. 2 and 3 perspectively illustrate two knitting stages of an article, showing it not in the arrangement it assumes in the machine, but approximately in the arrangement the finished article has when it is worn;

Figure 4:
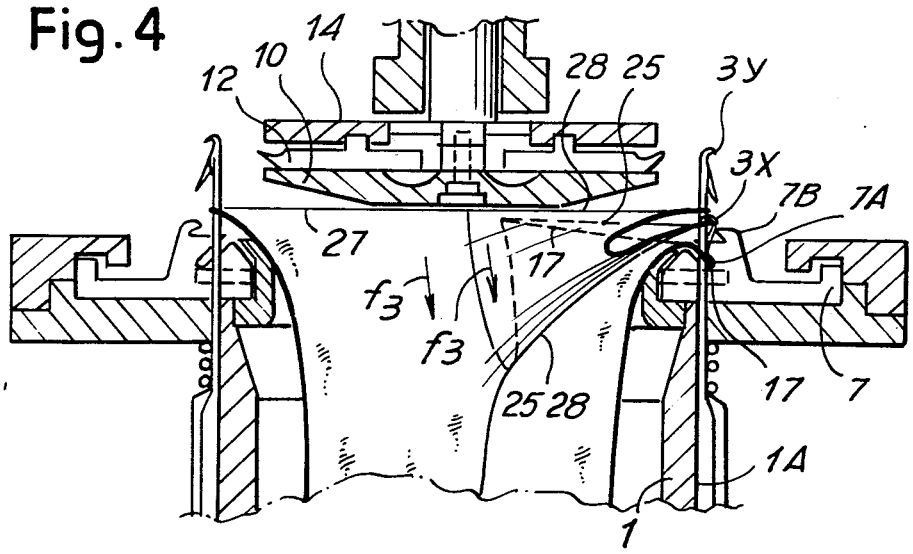
FIGS. 4 and 5 are cross sectional views of the needle cylinder in the stage of FIG. 3 and a perspective view of the article as it appears in said stage on the needle cylinder, respectively.
Figure 5:
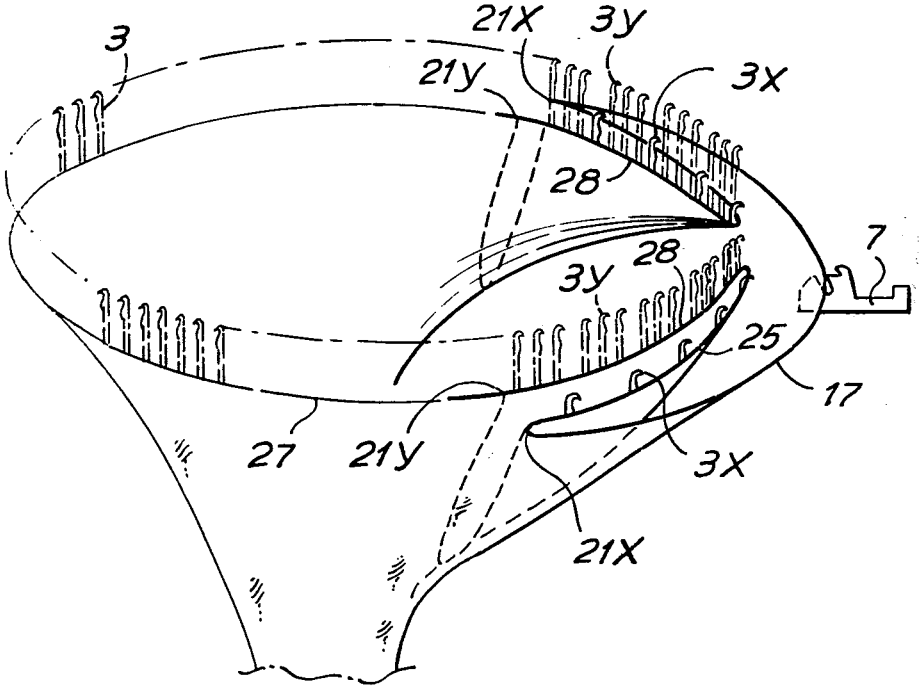

According to what is illustrated in the accompanying drawing (especially see FIG. 4) of a circular knitting machine and in particular a circular stocking machine - of the substantially conventional type - 1 denotes the needle cylinder, in whose grooves 1A needles 3 move, diagrammatically indicated, and control and selection sliders or jacks, not shown. 5 indicates a ring, surrounding and integral to the needle cylinder, in which radial grooves 5A are formed for the sliding of sinkers 7 of a particular type, provided with a recess 7A under the active profiles and under the hook 7B of said sinkers, to form a retaining means of the stitch adapted to transfer said stitch to the needles with a suitable combined motion of the sinkers and the needles (as shown, for instance, in the Italian Utility Model to Moretta No. 82,752 filed on May 21, 1960). The machine — for processes possibly requested for knitting the article of this invention and for other possible uses — may be provided with a conventional hooks dial 10, coaxial and slightly above the needle cylinder and synchronously rotating therewith; said hooks dial has radial slits along which hooks 12 of a known type and for purposes well known to the art may slide; said hooks 12 may be promptly controlled by means of cam profiles arranged on a fixed disc-like structure 14 closesly above the dial.

Figure 6:
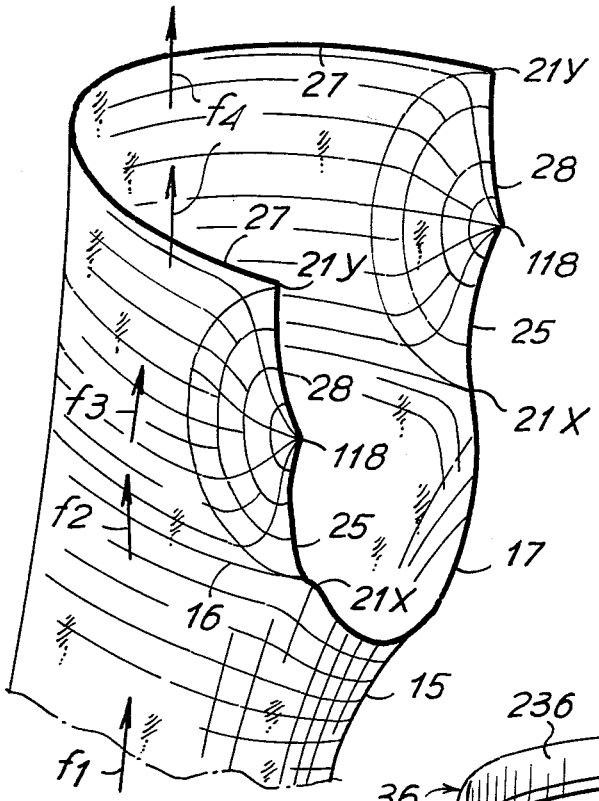
FIGS. 6, 7, 8, 9 and 10 illustrate other subsequent stages of the article knitting, in the same way as used for FIGS. 2 and 3.

In knitting panty hose according to the present invention, the leg portion 15 is first knit by continuous circular knitting on all needles of the cylinder up to the course designated by the numbers 16 and 17, which represent one continuous circular knit course. At that point the sinkers 7 are retracted and immediately reinserted to capture in the sinker recesses 7A all of the sinker loops that are along the line 17, which is the arc 2020, thereby holding the fabric down out of the knitting so that the needle loops will not be cast off as the needles continue a knitting operation and there will be no interknitting of the loops of the subsequent course along the line 17. When the next course following that of line 17 is knit, all of the needles in the arc 24 of the cylinder knit while all of the needles in the arc 2020 also knit forming a course (designed to form the line 25.) Immediately afterwards, at each revolution a course continues to be formed along the arc 24 and along the arc 2020, the needles 3X (one every four) are, however, held down; by the other needles 3Y of said arc 2020 together with the needles of the arc 24 the fabric is thus formed according to the arrows f2 along the arc 24 and simultaneously the pocket between the needles 3X and 3Y is formed, to be seen to the right of FIG. 4, the needles 3X retaining the edge 25. In the course of this operation, while the needles of the arc 24 form the fabric between the lines 16 and 27, along the arc 2020 the number of active needles are reduced, increased, then reduced again and repeatedly increased in said arc 2020, with progressive modifications of the arc of working needles between each point 21 and a point moving between said point 21 and point 18; the disc-sector fabric visible in FIG. 6 is thereby formed adjacent the line 21X-25-118-28-21Y. All this knitting is carried out with a continuous rotation movement of the cylinder and cutting the yarn at the last working needles of the increasing and decreasing needle arcs in the area 2020. Knitting this way one proceeds to the situation shown in FIG. 6.

At this point, knitting continues on the needles of arc 201 only and the first course is transferred onto the transfer bits 12 in the dial 14. Knitting continues of the arc 201 until a length of fabric for the welt-like or sheath-like band 236 is completed, following which the course held on the transfer bits 12 is transferred back to the needles in the same manner as is well known in forming turned welts on stockings. Following this an after welt portion or lip 238 is knit on the needles of the arc 201. Up to this point following knitting of the course 16–17, there has been continuous rotation of the knitting cylinder and cutting and refeeding of the yarn above the withdrawn needles in the arc 2020.

Following knitting of the after welt or lip 238, all of the needles of arc 201 are drawn down to cast off the loops and free the fabric thereat. Then, feeding of yarn to the needles of arc 201 starts a new course of fabric free from the previously knit course of the after welt 236 and this new course is transferred to the transfer bits 12 as knitting continues on the needles in the arc 201 to form another welt-like or sheath-like portion 236A, at the end of which the transfer bits transfer the held loops back into the next knit course to form the welt-like band 236A that, when knit, is immediately above the previously knit band 36, but which in the opened fabric will be positioned as a supplementary half band that combines with the half band 36 to form a full, but interrupted band on the finished garment.

Figure 8:
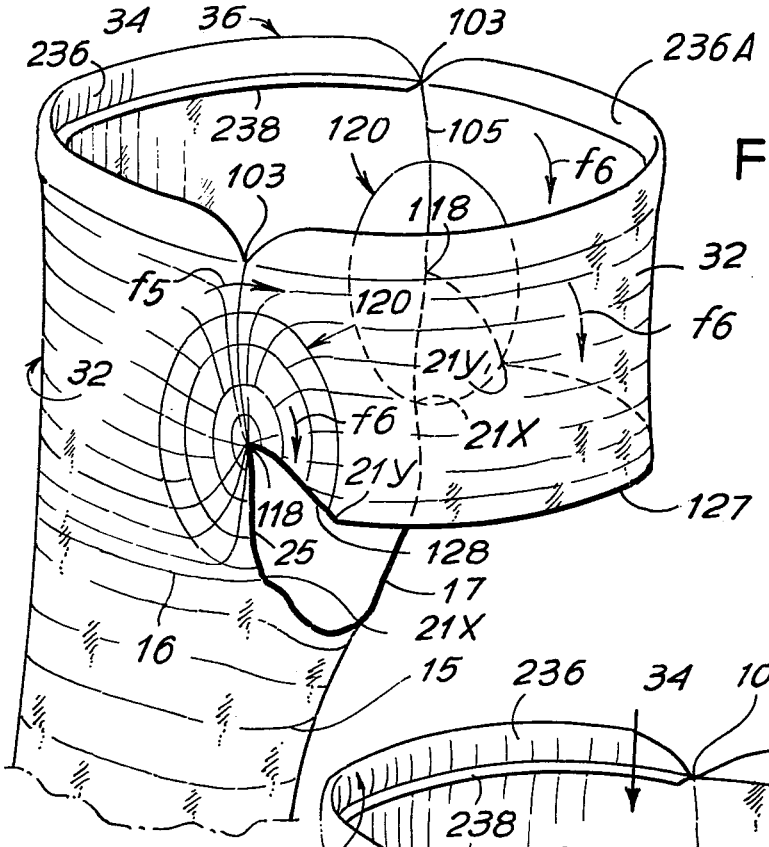

After the band 236A is completed, knitting continues on the needles of arc 24 in the sequence reversed to the knitting which had taken place between the front 16 and the welt 236 up to the line 127–128 (FIG. 8). Knitting continues now also with the insertion of the every fourth needle 3X that had been withdrawn in forming the fabric along the line 25. This insertion joins the newly knit courses 128 to the previously knit courses 35, i.e. unites the lines 128 and 25, respectively. All of the needles in arch 2020 are then withdrawn from the loops to cast off the fabric at lines 25, 128. At this point, all of the needles in arc 24 have yarn loops thereon, while all of the needles in arc 2020 have cast off all of the immediately previous knit loops but still have on their shanks the loops of the line 17 held under the sinkers. At this point the sinkers retract to free the loops of line 17 and then move back under the freed loops so that there are now loops available for knitting on all needles of the cylinder and the next course of knitting is a continuous uncut course that knits together the last knit course of arc 24 with the originally sinker-retained course 17 of arc 2020. This continuous circular knitting then continues to knit the other leg portion 152 of the complete panty hose.

On starting the process of the present invention, a tubular knit fabric 15 for a leg portion, is formed according to the arrows f1 by using all the cylinder needles and also a closure of the initial end of the article may be provided. At the end of this first stage (see FIG. 2) there is a needle front formed by a line 16 and a line 17, separated by two points 21X.

For a further clarification of the criterion according to which the body portion of the panty-hose of the invention is formed, a separation of needle arcs along the needle circumference is effected on the needle cylinder, the needle cylinder always rotating with a continuous motion. A single point, hereinafter referred to as "origin" and referenced by 18, may be defined in practice by a needle (also indicated by 18) which remains inactive during the formation of the body portion; said "origin" could also be made up by a number of inactive needles in the aforesaid time, or even by no needle at all. As it can be seen in the diagram in FIG. 1, adjacent to said origin 18 a needle arc 20, is formed on either side, being either for instance of about 50 needles, between the point 18 and two points 21; said arcs 20 are contiguous and symmetrical with respect to the origin 18 and define a first crotch arc 2020; in correspondence to these arcs 20, while the body portion is being knitted, cyclical decreases and increases of the simultaneously active needle arcs are provided for forming partial stitch courses, similarly to the principle by which - with a continuous circular motion of the needle cylinder - pockets in a tubular article are formed, for instance, for forming the stocking heel portion. The line 17 corresponds to the aforesaid first arc 2020 between the two points 21 and forms the crotch arc, the points 21 corresponding to the points 21X on the article.

Figure 7:
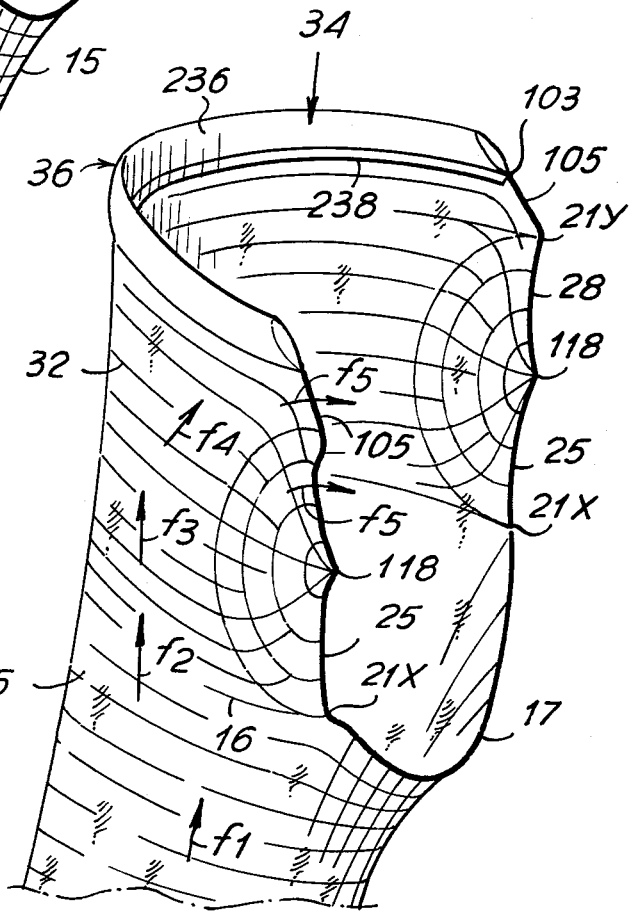
Figure 9:
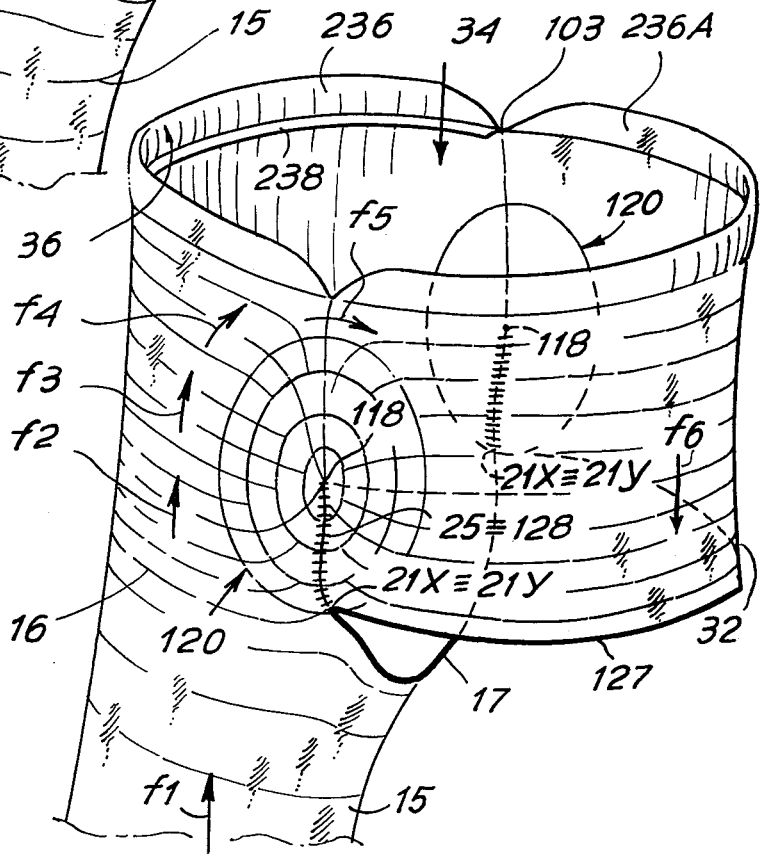

After reaching the front 16, 17, the knit along the line 17, i.e. along the first arc, is engaged by the retaining means formed by the recesses 7A of the sinkers 7, while along the line 16, which corresponds to the needle arc 24, and is supplementary to the arc 2020, i.e. to the sum of the two arcs 20 (arc 24 + arc 2020 = 360°), the knit fabric remains engaged on the needles along the line 16, i.e. along the arc 24. Now the knitting of a new fabric is started along the arcs 20, 20, with a separation at the origin point 18, and the starting portion of said knit fabric, indicated at 25, is retained by some 3X of the needles of the arcs 20, for instance, one every three, while the other needles 3Y go on knitting cooperating with the needles of the arc 24, with a circular motion of the needle cylinder and with an interruption at the origin at 18. The article is thus formed at this stage by the needles along the line indicated by 27 and 28, 28; the line 27 corresponds to the needle arc 24 and is ideally separated by the points 21Y from the lines 28, 28, which correspond to the arcs 20 and which are separated from each other at the origin point 18. Between the lines 25 and 28 a part of the disc like knit area is formed as a decreasing pocket. During the formation of the body portion the knitting proceeds according to the arrow f2 at the beginning, and then according to the arrows f3 and f4 in FIGS. 3 and 6, always with a continuous circular motion of the needle cylinder. Along the needle front which corresponds to the lengths 25 and 28, accordingly to the needle arcs 20 contiguous to the origin 18, partial stitch courses are formed with decreasing and increasing cycles of the active needle arcs; the groups of simultaneously excluded needles start at the origin 18 along the contiguous and opposite arcs 20, said simultaneously excluded needle groups may be equal or different in the two contiguous needle arcs 20 depending this on whether either symmetry or asymmetry in forming the disc areas of the front and rear body portion is desired. The partial stitch courses (which include the whole arc 24 and portions of the needle arcs 20 adjacent thereto) are obtained by shearing the yarn at the ends of the courses and by anchoring the yarn, which is conventionally obtained through a selection of the needles, at the end of said simultaneously knitting needle arcs to form the partial courses. Consequently, during the knitting of the body portion the knit is increased, extending according to the arrows *f*4 and *f*5 around the two origins 118 located in front and rearwards in the article, as shown in FIGS. 7 to 9, the two lines 28 between the points 21Y and 118 of the working front corresponding to the knit areas with increased and decreased stitches along the arcs 20 adjacent to the origin 18 defined in the needle circumference; around the two origins 118 of the knit of the body portion 32 — in correspondence of the increased and decreased stitches originating courses of partial stitches having an equal length — patterns are formed substantially concentric to said origins 118 and indicated by a series of circumferences forming disc-like areas 120 (see FIGS. 8 and following).

The knitting of the body portion proceeds and it may advantageously include steps for forming an intermediate opening of the article in the area of the body portion 32, to form the waist opening and the waist line of the finished article. This opening defining the waist line is generically indicated by 34 in the drawing and may be completed with a suitable finish of the edges defining it; said finish may be formed by tubular sheath like edges 36 and/or by loops of elastic yarns to render said edges of the opening 34 elastic. Apart from the detailed description of the knitting of the opening 34 and of the edges of the waist line (such as those denoted by 36), in order to complete the description of the knitting of the article, with a reserve to revert to the forming of the opening 34 in the continuation of the description.

By continuing the increased and decreased stitch knitting in the stitch partial courses (which are developed with ends more or less remote from the origin 18) the body portion 32 is formed according to the arrows *f*2, *f*3, *f*4, *f*5, *f*6 — as above stated —. During the knitting of the body portion 32, the knit of the body portion extends in correspondence of the arcs 20 with a loop or pocket 2528 (FIG. 4) between the needles 3X and 3Y, said loop having the maximum depth in correspondence of the points 21X and 21Y and decreasing depth along the contiguous arcs 20 until it disappears at the origin 18 (i.e. at the two origins 118 — front and rear — in the knit), while adjacent to said origins and in correspondence of the decreasing depth the circumferential patterns of the discs 120 are formed corresponding to the anchoring loops and to the sheared ends of the yarns forming the different partial courses. The knitting of the article area forming the body portion 32 is shown in the stages of FIGS. 3, 6, 7, 8 and the knitting proceeds then in the following manner. When the knitting of the body portion according *f*6 of FIG. 8 reaches a symmetric condition with the area starting from line 16, the needle working front is that shown in 127 and 128 in FIG. 8, the front 128 corresponding to the knit starting front 25 which is retained by the sinkers 7. When the fabric formed by advancing according to the arrows *f*6 reaches the front 127, 128 in FIG. 8, the needles 3X and 3Y of both contiguous arcs 20 are operated to connect the initial and final edges 25 and 128; immediately after two end or final lips are formed by the needles of said two contiguous arcs 20; immediately after said end lips are abandoned by the needles of said contiguous arcs 20 and the arrangement of FIG. 9 is attained; in this arrangement the needles of both arcs 20 between the points 21 defining them and those at the origin 18 if any, i.e. the needles of the arc 2020, are clear of knit, while along the arc 24, the knit of the body portion remains engaged to the needles along the line 127.

Figure 10:
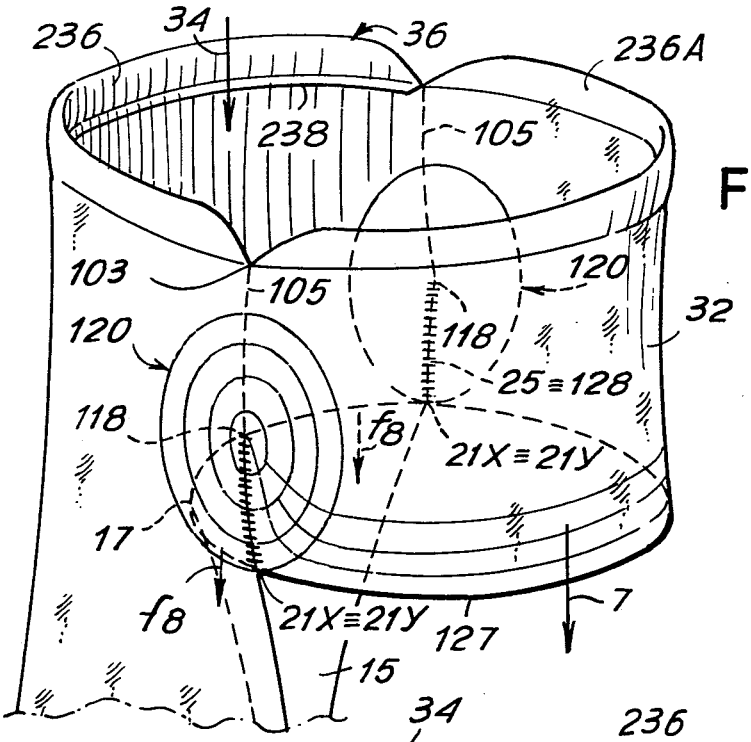
Figure 11:
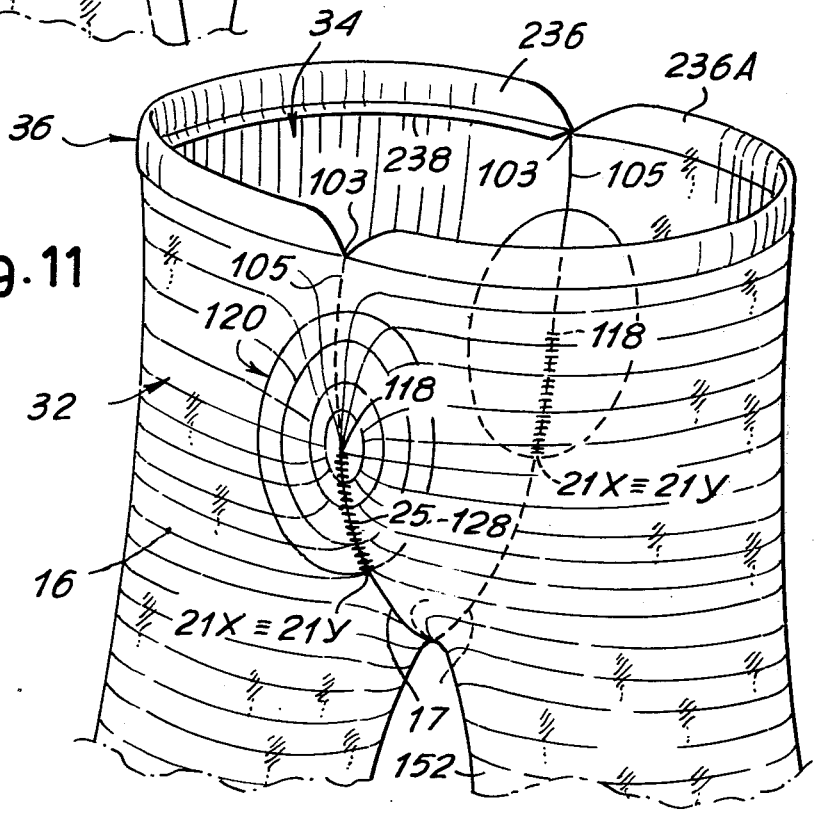
FIGS. 11 and 12 illustrate the finished article in a partial perspective view and in a front view, respectively, the disposition of the courses being shown by full lines.
Figure 12:
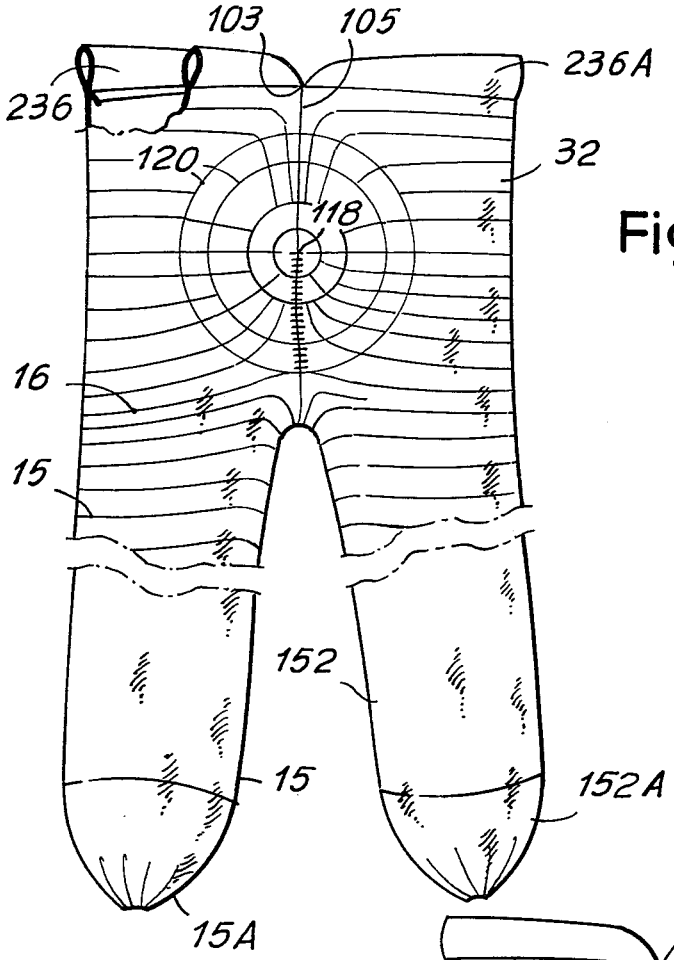
Figure 13:
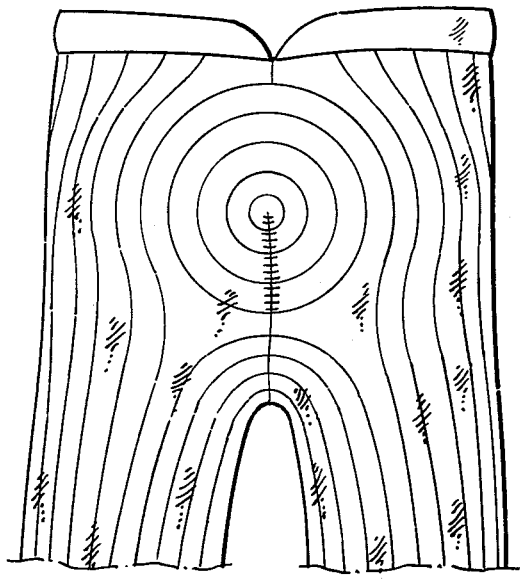
FIG. 13 is similar to FIG. 12 but here the lines show the disposition of the stitch rows.

At this point, the sinkers 7 and the needles of the arc 2020 are operated to return the knit front, defined by the crotch line 17, to the needles of said arc 2020. The knitting of the second leg portion 152 (see FIGS. 9 and 10) is then started with all the cylinder needles and in particular resuming the knit from the front 127 along the needle arc 24 according to the arrow *f*7 and starting the knit according to the arrows *f*8 along the crotch line 17 by the needles and the sinkers of the needle front formed by the two needle arcs 20 and also by that single needle or those needles which during the knitting of the disc 120 have been inactive, forming the "origin" indicated by 18. In correspondence of the crotch (line 17) the knit is started again after the dwell on the sinkers 7 in correspondence of the arc 2020. The leg portion knit 152 proceeds to the complete knitting of the required length, whereafter the needles are cleared of the article abandoning the tubular knit of the leg portion 152; before that, it may be provided the finish of the end as for the first leg portion, for instance, by forming a toe closure. The toe closures 15A and 152A (see FIG. 12) may be carried out by conventional systems, also using the hooks 12.

A manner for forming the opening 34 with a finish of the edges thereof will now be described.

When the forming of a half the knit of the body portion 32, under a condition substantially corresponding to the arrangement of FIG. 6, is reached, one provided to form the opening 34 along a needle arc 201 which is symmetrical with respect to the diameter of the origin 18 and opposite thereto and which is developed between two points 203, with an extent of nearly hundred and eighty to two hundred and twenty needles 3 and a number of hooks 12 a half thereof; each of the ends 203 of said arc 201 is over a needle arc 205 away from the respective point 21, for instance, of about fifty needles; the arc 201 thus results to be about 180°. In the article, the end points 203 of the needle arc 201 correspond to the points 103, and the front 105 corresponds to the arc 205. Along said arc 201 the fabric 32 being formed is transferred in a known way to the hooks 12 and the needles of said arc 201 when active form the knit 36 between the hooks and said needles, with a well known sysem and originally used by Scott & Williams; the needles external to the arc 201 — i.e. those of the arcs 205 and 20 — may go on working on their respective front, or may remain temporarily inactive retaining the knit fabric; the knitting always takes place with a continuous rotation of the needle cylinder. Once the knit portion 236 has been formed to a sufficient amount to make up the edge 36 of the opening 34 (in the form of an annular sheath like edge) on the left-hand portion of said opening 34, looking at the drawing, the hooks 12 are operated to yield again the knit fabric to the needles, always limitedly to the arc 201. Immediately after, the needles of the arc 201 are operated to form a final lip 238; thereafter said needles of the arc 201 are operated to abandon said final lip 238.

After abandoning the final lip 238 along said arc 201, the needles, now free, of this arc are operated to start again to knit at 236A, in cooperation with the hooks 12, in a manner similar to techniques already known to the people skilled in the art to form at the beginning of an article a double edge or tubular sheath. After knitting an amount of knit 236A corresponding to that denoted by 236, the hooks 12 are operated to yield the beginning of the knit portion 236A to the needles. After this, the knitting is resumed to form additional knit fabric to the body portion 32 as already described, according to the arrows *f5* and *f6* (FIG. 8). The opening 34 is thus formed with a development twice that corresponding to the arc 201 and said opening is completed with an edge 36 formed by the two tubular sheath knits 236, 236A.

The waist opening 34 may be formed even without such tubular sheath-like knit fabric as 236, 236A; in this case, after forming the first part of the body portion 32 substantially to the arrangement in FIG. 6, by using just the needles of the arc 201, a final lip like the one denoted by 238 is directly formed and then the knit fabric is abandoned by said needles of the arc 201 and then the knitting is resumed to proceed according to the arrows *f6* to form the second part of the body portion 32, together with the other needles and with the increased and decreased loops as previously stated.

During the knitting near the opening 34 (and advantageously also that of the body portion 32 and, if any, that of the edge 36 or the like), it may be provided to insert an elastic yarn to obtain a suitable number of courses of elastic stitches. Thereby an advantageous elastic band in correspondence of the waist line is obtained. Nothing forbids that an elastic yarn — equal or possibly lighter than that used for forming the elastic band along the opening 34 of the waist line — is used for knitting the whole body portion 32 or most of it for instance between the lines 16 and 127.

During the forming of the opening 34 for the waist line, the needle cylinder maintains the continuous rotational motion, and the yarn or the yarns fed to the needles of the arc 201 are sheared at the beginning and at the end of said needle arc, with suitable known devices for anchoring the yarn ends, so as to avoid ladders; for instance, the end needles of the arc 201 may be operated with a selection 1:1 or the like. It is to be noted that with the use of elastic yarns, the anchoring of the ends of said yarns is facilitated.

From the above it is apparent that with circular knitting or stocking machines and without any particular equipment, (except an appropriate needle selection program), one may obtain, with a continuous rotational movement of the needle cylinder, a panty-hose article which is practically complete and with a satisfactory sizing in the proportion between the leg and the body portions, the sizing being substantially comparable to that of the conventional panty-hose provided with fitting piece and manually sewn starting from three independent articles (two stockings with a longitudinal slit and a fitting piece). The production of articles according to the invention is a substantially fast one.

What is claimed is:

1. Process for forming a panty-hose type article with a continuous rotational motion of the needle cylinder, in a circular knitting machine which is provided with retaining means - such as sinkers with a rear recess - to support the knit fabric along the working area of the needles of the cylinder, in such a manner as to receive and retain said knit fabric from the needles and subsequently return it to the needles, said process including:

forming a first leg portion of tubular knit fabric by knitting with all the needles;

engaging a portion of the knit fabric working front on said retaining means along a first arc of needles corresponding to the crotch and retaining said knit fabric thereon, with the needles being free to knit fabric separator from the portion on said retaining means;

starting two initial edges of two disc - like areas along two semiarcs wherein said first arc is divided by a central origin and retaining said initial edges;

forming the body portion by continuing knitting along the arc supplementary to said first arc and through pocket portions formed between said initial retained edges and the active needles of said both semiarcs, by cyclically activating and deactivating along each semiarc variable needle arcs starting from said origin, and by anchoring the produced partial courses to the contiguous ones thus forming two disc-like areas - front and rear - and an arcuated and tapered fabric;

connecting said initial edges and the corresponding end edges along said two semiarcs contiguous and symmetrical, to the origin, and forming a final lip for unthreading and clearing the needles of said two semiarcs;

resuming by the needles of said first arc the knitting along the line retained by said retaining means; and starting a second tubular leg portion knit along said first arc of the crotch formed by said two contiguous semiarcs and by the origin included therebetween, said second tubular knit portion being partly formed as a continuation of the working front of the needles of the arc supplemental to said first arc of the crotch.

2. A process as in claim 1, further including: during the knitting of the body portion the formation of an opening for the waist line by interrupting and then resuming the operation along a second arc of needles opposite to said origin and to said first arc and symmetrical with respect to the diametrical direction defined by said origin; and the finishing of said opening with final lips and with an eventual double sheath-like edge.

3. A process as in claim 1, wherein the initial edges are retained by means of needles kept inactive and intervening with the active needles which are working.

4. A process as in claim 1, wherein a double sheath-like edge of said opening is formed between the needles and the dial hooks along said second arc, and advantageously by means of an electric yarn.

5. A process as in claim 1, including the forming of a closure of the article to form a toe at the end of each leg portion.

* * * * *